US012403514B2

(12) United States Patent
Ogasahara et al.

(10) Patent No.: US 12,403,514 B2
(45) Date of Patent: Sep. 2, 2025

(54) STEEL-SHEET MEANDERING AMOUNT MEASUREMENT DEVICE, STEEL-SHEET MEANDERING AMOUNT MEASUREMENT METHOD, HOT-ROLLING EQUIPMENT FOR HOT-ROLLED STEEL STRIP, AND HOT-ROLLING METHOD OF HOT-ROLLED STEEL STRIP

(71) Applicant: JFE Steel Corporation, Tokyo (JP)

(72) Inventors: Tomoyoshi Ogasahara, Tokyo (JP); Hiroto Goto, Tokyo (JP); Hideto Yamaguchi, Tokyo (JP); Yukihiro Matsubara, Tokyo (JP); Mitsutoshi Kemmochi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 238 days.

(21) Appl. No.: 18/274,636

(22) PCT Filed: Dec. 13, 2021

(86) PCT No.: PCT/JP2021/045855
§ 371 (c)(1),
(2) Date: Jul. 27, 2023

(87) PCT Pub. No.: WO2022/163177
PCT Pub. Date: Aug. 4, 2022

(65) Prior Publication Data

US 2024/0091835 A1 Mar. 21, 2024

(30) Foreign Application Priority Data

Jan. 28, 2021 (JP) ..... 2021-012395

(51) Int. Cl.
*B21B 38/04* (2006.01)
*B21C 51/00* (2006.01)

(52) U.S. Cl.
CPC ..... *B21B 38/04* (2013.01); *B21C 51/00* (2013.01)

(58) Field of Classification Search
CPC ..... B21B 37/68; B21B 38/00; B21B 38/04; B21C 51/00
See application file for complete search history.

(56) References Cited

U.S. PATENT DOCUMENTS

2013/0098127 A1 4/2013 Isei et al.

FOREIGN PATENT DOCUMENTS

CN 102918353 A 2/2013
CN 110906875 A 3/2020
(Continued)

OTHER PUBLICATIONS

Translation of WO-2018168700.*
(Continued)

*Primary Examiner* — Bobby Yeonjin Kim
(74) *Attorney, Agent, or Firm* — DLA Piper LLP (US)

(57) ABSTRACT

A meandering amount arithmetically operating device of a meandering amount measurement device calculates the meandering amount of a steel sheet using a drive side edge site $z_{ds}(N)$ and a work side edge sites $z_{ws}(N)$ at a current time when a measurement reliability determination unit determines that both the drive side edge site $z_{ds}(N)$ and the work side edge sites $z_{ws}(N)$ at the current time have high reliability. When only one of the drive side edge site $z_{ds}(N)$ and the work side edge site $z_{ws}(N)$ at the current time is determined to have high reliability, the other edge site is calculated by interpolation using the number of pixels W from a sheet width updating unit with the drive side edge sites $z_{ds}(N)$ or the work side edge site $z_{ws}(N)$ at the current time having high reliability as a reference.

4 Claims, 9 Drawing Sheets

(56) References Cited

FOREIGN PATENT DOCUMENTS

| | | | | | |
|---|---|---|---|---|---|
| EP | 4 005 693 | A1 | | 6/2022 | |
| JP | S61226213 | A | | 10/1986 | |
| JP | S63-225107 | A | | 9/1988 | |
| JP | 2004-141956 | A | | 5/2004 | |
| JP | 5454404 | B2 | | 1/2014 | |
| JP | 6801833 | B1 | | 11/2020 | |
| KR | 960030645 | A | | 8/1996 | |
| KR | 20010099965 | A | * | 11/2001 | ..... G01B 11/046 |
| WO | WO-2017111414 | A1 | * | 6/2017 | ..... G01N 21/89 |
| WO | WO-2018168700 | A1 | * | 9/2018 | ..... G06T 7/13 |

OTHER PUBLICATIONS

Translation of WO-2017111414.*
Translation of KR-20010099965.*
English translation of the International Preliminary Report on Patentability and Written Opinion dated Aug. 1, 2023, of counterpart PCT International Application No. PCT/JP2021/045855.
Yoshiro Washikita et al., "Development of Walking Control Technology in Hot Strip Rolling," Tetsu-To-Hagane/Journal of the Iron and Steel Institute of Japan, vol. 95, No. 1, 2009, pp. 43-50.
International Search Report dated Jan. 11, 2022 in counterpart International Application No. PCT/JP2021/045855 w/English translation.
Written Opinion dated Jan. 11, 2022 in counterpart International Application No. PCT/JP2021/045855.
Office Action dated May 29, 2025, from counterpart Chinese Patent Application No. 202180092073.6.

* cited by examiner (c)

STEEL-SHEET MEANDERING AMOUNT MEASUREMENT DEVICE, STEEL-SHEET MEANDERING AMOUNT MEASUREMENT METHOD, HOT-ROLLING EQUIPMENT FOR HOT-ROLLED STEEL STRIP, AND HOT-ROLLING METHOD OF HOT-ROLLED STEEL STRIP

TECHNICAL FIELD

This disclosure relates to a steel-sheet meandering amount measurement device measuring the meandering amount of a steel sheet during rolling by a rolling mill having a plurality of rolling stands, a steel-sheet meandering amount measurement method, hot-rolling equipment for hot-rolled steel strip, and a hot-rolling method of hot-rolled steel strip.

BACKGROUND

In general, during rolling of a steel sheet by a hot finish rolling mill having a plurality of rolling stands, a phenomenon referred to as meandering sometimes occurs in which the steel sheet is rolled in a state where a center part of the width of the steel sheet is displaced with respect to a center part of work rolls of the rolling stands. When the meandering amount of the steel sheet increases, the steel sheet sometimes comes into contact with a side guide installed on the entry side of the rolling mill and is buckled. When the steel sheet is rolled in this state, a roll breakage trouble referred to as squeezing occurs. Therefore, it is required in a rolling operation of the steel sheet to appropriately set rolling conditions and control the meandering amount of the steel sheet to be as small as possible.

In controlling the meandering amount of the steel sheet, "Differential load type meandering control" and "Sensor type meandering control" are conventionally known.

The "Differential load type meandering control" changes the leveling amount of a rolling stand to be controlled (roll opening difference, which is a roll gap opening difference, between the operation side and the drive side in the rolling stand to be controlled) to be proportional to a differential load between the operation side and the drive side detected from a load detector provided in the rolling stand.

The "Sensor type meandering control" changes the leveling amount of a rolling mill stand to be controlled to be proportional to the meandering amount measured by a meandering amount measurement device installed between a rolling stand one before the rolling stand to be controlled and the rolling stand to be controlled.

Conventionally, "Development of Walking Control Technology in Hot Strip Rolling," Iron and Steel, Vol. 95 (2009), No. 1, pp 43-50 points out that that the "Differential load type meandering control" is not an effective control measure because, when the sheet width is larger, the meandering suppression effect becomes smaller in the practical control gain setting range in the "Differential load type meandering control." To solve this, a control system has been proposed in which a "Meandering meter type meandering control" is adopted and the meandering amount between a rolling stand one before a rolling stand to be controlled and the rolling stand to be controlled is periodically measured by the meandering amount measurement device, and the leveling amount of the rolling mill stand to be controlled is adjusted.

Between the rolling stands in the hot finish rolling mill, a large amount of vapor or fumes are generated, and therefore these vapor or fumes block the measurement field of view of a camera in the meandering amount measurement device, which poses a problem that the meandering amount of the steel sheet cannot be measured with high accuracy.

To solve this problem, "Development of Walking Control Technology in Hot Strip Rolling" proposed a method of calculating a point where the differential intensity is maximum (corresponding to the edge of the steel sheet) for each scanning line of the camera, and then estimating the edge line by the weighted least-squares method using the differential intensity as the weight.

Further, to solve the above-described problem, conventionally, a sheet material meandering measurement method described in JP 2004-141956 A has been proposed.

The sheet material meandering measurement method described in JP '956 includes: a step of imaging the surface of the sheet material with a two-dimensional imaging device from a direction inclined in the rolling direction with respect to the perpendicular line of a pass line; a step of detecting the edge position of the sheet material for each scanning line by detecting a change in a density value for each scanning line in the sheet width direction for a captured image; a step of calculating an approximate straight line by applying the least-squares method to each edge position detected for each scanning line; a step of calculating the position of the intersection of the approximate straight line and the predetermined scanning line; and a step of calculating the meandering amount based on the position of the intersection.

Further, to solve the above-described problem, conventionally, an edge detection method described in JP 5454404 B has also been proposed.

The edge detection method described in JP '404 includes: an imaging step of capturing a plurality of images of a region including an edge line of a traveling member with an imaging means, a differential image generation step of generating a differential image by determining the differential intensity of pixels in the image for each of a plurality of temporally continuous images obtained by the imaging step; and a synthesized differential image generation step of synthesizing the plurality of temporally continuous differential images obtained by the differential image generation step and generating a synthesized partial image. Further, the edge detection method includes: a straight line specifying step of specifying a straight line where the differential intensity sum of pixels present on the straight line is maximum in the synthesized differential image obtained by the synthesized differential image generation step; and a determination step of determining whether the differential intensity of the pixels is larger than a threshold.

Between the rolling stands in the hot finish rolling mill, a large amount of vapor or fumes are generated. Only one edge of the steel sheet cannot be detected because the edge is covered with the vapor or the fumes while the other edge of the steel sheet can be detected because the edge is not covered with the vapor or the fumes in some instances.

Both the conventional sheet material meandering measurement methods described in "Development of Walking Control Technology in Hot Strip Rolling" and JP '956 and the conventional edge detection method described in JP '404 are calculation methods in which the meandering amount is calculated only when the edges on both sides of the steel sheet can be detected. This has posed a problem that, when one edge cannot be detected while the other edge of the steel sheet can be detected, the meandering amount of the steel sheet cannot be detected.

It could therefore be helpful to provide a steel-sheet meandering amount measurement device capable of exactly measuring the meandering amount of the steel sheet in measuring the meandering amount of the steel sheet during rolling, not only when both the edges of the steel sheet can be detected but even when one edge of the steel sheet cannot be detected because the edge is covered with vapor or the like while the other edge of the steel sheet can be detected because the edge is not covered with vapor or the like, a steel-sheet meandering amount measurement method, a hot-rolling equipment for hot-rolled steel strip, and a hot-rolling method of hot-rolled steel strip.

SUMMARY

We thus provide:

A steel-sheet meandering amount measurement device measures the meandering amount of a steel sheet during rolling by a rolling mill having a plurality of rolling stands, and includes: an imaging device installed between the rolling stands adjacent to each other and configured to periodically image the surface of the steel sheet traveling during rolling; and a meandering amount arithmetically operating device configured to calculate the meandering amount of the steel sheet based on a plurality of captured images captured by the imaging device; in which the meandering amount arithmetically operating device includes: an uncorrected edge detection unit configured to calculate a luminance difference between pixels adjacent to each other in the width direction of each of the plurality of captured images periodically captured by the imaging device, detect a plurality of sites where the absolute value of the luminance difference is maximum on a drive side in the width direction of the steel sheet as a drive side edge site $z_{ds}$ of the steel sheet, and detect a plurality of sites where the absolute value of the luminance difference is maximum on a work side in the width direction of the steel sheet as a work side edge site $z_{ws}$ of the steel sheet; a measurement reliability determination unit configured to determine that the drive side edge site $z_{ds}(N)$ and the work side edge site $z_{ws}(N)$ at a current time have low reliability when each of the sums $\alpha_{ds}$, $\alpha_{ws}$ of change amount absolute values is equal to or larger than a predetermined threshold, and determine that the drive side edge site $z_{ds}(N)$ and the work side edge site $z_{ws}(N)$ at the current time have high reliability when each of the sums $\alpha_{ds}$, $\alpha_{ws}$ is less than the predetermined threshold, the sums $\alpha_{ds}$, $\alpha_{ws}$ being represented by Equations (1), (2) of the drive side edge sites ($z_{ds}(i)$, i=1, 2, . . . , N) and the work side edge sites ($z_{ws}(i)$, i=1, 2, . . . , N), detected by N times in the past including the current time extracted from the plurality of drive side edge sites $z_{ds}$ and work side edge sites $z_{ws}$, respectively, detected by the uncorrected edge detection unit; a sheet width updating unit configured to calculate the number of pixels W' corresponding to the sheet width calculated from both the drive side edge site $z_{ds}(N)$ and the work side edge site $z_{ws}(N)$ at the current time and update the number of pixels W corresponding to the sheet width to the calculated W' when the measurement reliability determination unit determines that both the drive side edge site $z_{ds}(N)$ and the work side edge site $z_{ws}(N)$ at the current time have high reliability, and leave the number of pixels W corresponding to the sheet width as the number of pixels W when the measurement reliability determination unit determines that at least one of the drive side edge site $z_{ds}(N)$ and the work side edge site $z_{ws}(N)$ at the current time has low reliability; and a meandering amount calculation unit configured to calculate the meandering amount of the steel sheet using the drive side edge site $z_{ds}(N)$ and the work side edge site $z_{ws}(N)$ at the current time when the measurement reliability determination unit determines that both the drive side edge site $z_{ds}(N)$ and the work side edge site $z_{ws}(N)$ at the current time have high reliability, calculate by interpolation the other side edge site using the number of pixels W from the sheet width updating unit with the drive side edge site $z_{ds}(N)$ or the work side edge site $z_{ws}(N)$ at the current time having high reliability as a reference and calculate the meandering amount of the steel sheet using the drive side edge site $z_{ds}(N)$ or the work side edge site $z_{ws}(N)$ at the current time having high reliability and the other side edge site subjected to the calculation by interpolation when the measurement reliability determination unit determines that only one of the drive side edge site $z_{ds}(N)$ and the work side edge site $z_{ws}(N)$ at the current time has high reliability, and not calculate the meandering amount of the steel sheet when the measurement reliability determination unit determines that both the drive side edge site $z_{ds}(N)$ and the work side edge site $z_{ws}(N)$ at the current time have low reliability:

$$\alpha_{ds}=\Sigma_{i=2}^{N}|z_{dsi}-z_{dsi-1}| \quad (1)$$

$$\alpha_{ws}=\Sigma_{i=2}^{N}|z_{wsi}-z_{dwsi-1}| \quad (2)$$

Hot-rolling equipment for hot-rolled steel strip includes the steel-sheet meandering amount measurement device described above.

A steel-sheet meandering amount measurement method measures the meandering amount of a steel sheet during rolling by a rolling mill having a plurality of rolling stands, and includes: an imaging step of periodically imaging the surface of the steel sheet traveling during rolling by an imaging device installed between the rolling stands adjacent to each other; an uncorrected edge detection step of calculating a luminance difference between pixels adjacent to each other in the width direction of each of the plurality of captured images periodically captured in the imaging step, detecting a plurality of sites where the absolute value of the luminance difference is maximum on a drive side in the width direction of the steel sheet as a drive side edge site $z_{ds}$ of the steel sheet, and detecting a plurality of sites where the absolute value of the luminance difference is maximum on a work side in the width direction of the steel sheet as a work side edge site $z_{ws}$ of the steel sheet; a measurement reliability determination step of determining that the drive side edge site $z_{ds}(N)$ and the work side edge site $z_{ws}(N)$ at a current time have low reliability when each of the sums $\alpha_{ds}$, $\alpha_{ws}$ of change amount absolute values is equal to or larger than a predetermined threshold, and determining that the drive side edge site $z_{ds}(N)$ and the work side edge site $z_{ws}(N)$ at the current time have high reliability when each of the sums $\alpha_{ds}$, $\alpha_{ws}$ is less than the predetermined threshold, the sums $\alpha_{ds}$, $\alpha_{ws}$ being represented by Equations (1), (2) of the drive side edge sites ($z_{ds}(i)$, i=1, 2, . . . , N) and the work side edge sites ($z_{ws}(i)$, i=1, 2, . . . , N), detected by N times in the past including the current time extracted from the plurality of drive side edge sites $z_{ds}$ and work side edge sites $z_{ws}$, respectively, detected in the uncorrected edge detection step; a sheet width updating step of calculating the number of pixels W' corresponding to the sheet width calculated from both the drive side edge site $z_{ds}(N)$ and the work side edge site $z_{ws}(N)$ at the current time and updating the number of pixels W corresponding to the sheet width to the calculated W' when the measurement reliability determination step determines that both the drive side edge site $z_{ds}(N)$ and the work side edge site $z_{ws}(N)$ at the current time have high reliability, and leaving the number of pixels W corresponding to the sheet width as the number of pixels W when the measurement reliability determination step determines that at least one of the drive side edge site $z_{ds}(N)$ and the work side edge site $z_{ws}(N)$ at the current time has low reliability;

and a meandering amount calculation step of calculating the meandering amount of the steel sheet using the drive side edge site $z_{ds}(N)$ and the work side edge site $z_{ws}(N)$ at the current time when the measurement reliability determination step determines that both the drive side edge site $z_{ds}(N)$ and the work side edge site $z_{ws}(N)$ at the current time have high reliability, calculating by interpolation the other side edge site using the number of pixels W from the sheet width updating step with the drive side edge site $z_{ds}(N)$ or the work side edge site $z_{ws}(N)$ at the current time having high reliability as a reference and calculating the meandering amount of the steel sheet using the drive side edge site $z_{ds}(N)$ or the work side edge site $z_{ws}(N)$ at the current time having high reliability and the other side edge site subjected to the calculation by interpolation when the measurement reliability determination step determines that only one of the drive side edge site $z_{ds}(N)$ and the work side edge site $z_{ws}(N)$ at the current time has high reliability, and not calculating the meandering amount of the steel sheet when the measurement reliability determination step determines that both the drive side edge site $z_{ds}(N)$ and the work side edge site $z_{ws}(N)$ at the current time have low reliability.

A hot-rolling method of hot-rolled steel strip includes a step of measuring the meandering amount of a steel sheet during rolling by a rolling mill having a plurality of rolling stands by the steel-sheet meandering amount measurement method described above.

Our steel-sheet meandering amount measurement device, the steel-sheet meandering amount measurement method, the hot-rolling equipment for hot-rolled steel strip, and the hot-rolling method of hot-rolled steel strip can provide a steel-sheet meandering amount measurement device capable of exactly measuring the meandering amount of the steel sheet in measuring the meandering amount of the steel sheet during rolling, not only when both the edges of the steel sheet can be detected but even when one edge of the steel sheet cannot be detected because the edge is covered with vapor or the like while the other edge of the steel sheet can be detected because the edge is not covered with vapor or the like, a steel-sheet meandering amount measurement method, a hot-rolling equipment for hot-rolled steel strip, and a hot-rolling method of hot-rolled steel strip.

BRIEF DESCRIPTION OF THE DRAWINGS

FIGS. 9A to 9C are explanatory views when the drive side edge sites and the work side edge sites of the steel sheet are estimated by a Comparative Example, and the meandering amount of the steel sheet is calculated using the estimated drive side edge sites and work side edge sites, in which FIG. 9A illustrates estimated values of the work side edge sites, FIG. 9B illustrates estimated values of the drive side edge sites, and FIG. 9C illustrates calculated values of the meandering amount of the steel sheet.

FIGS. 10A to 10C are explanatory views in which the drive side edge sites and the work side edge sites of the steel sheet are detected and then determined, and the meandering amount of the steel sheet is calculated using the determined drive side edge sites and work side edge sites by an Example, in which FIG. 10A illustrates values of determination results of the work side edge sites, FIG. 10B illustrates values of determination results of the drive side edge sites, and FIG. 10C illustrates calculated values of the meandering amount of the steel sheet.

REFERENCE SIGNS LIST

Figure 1:
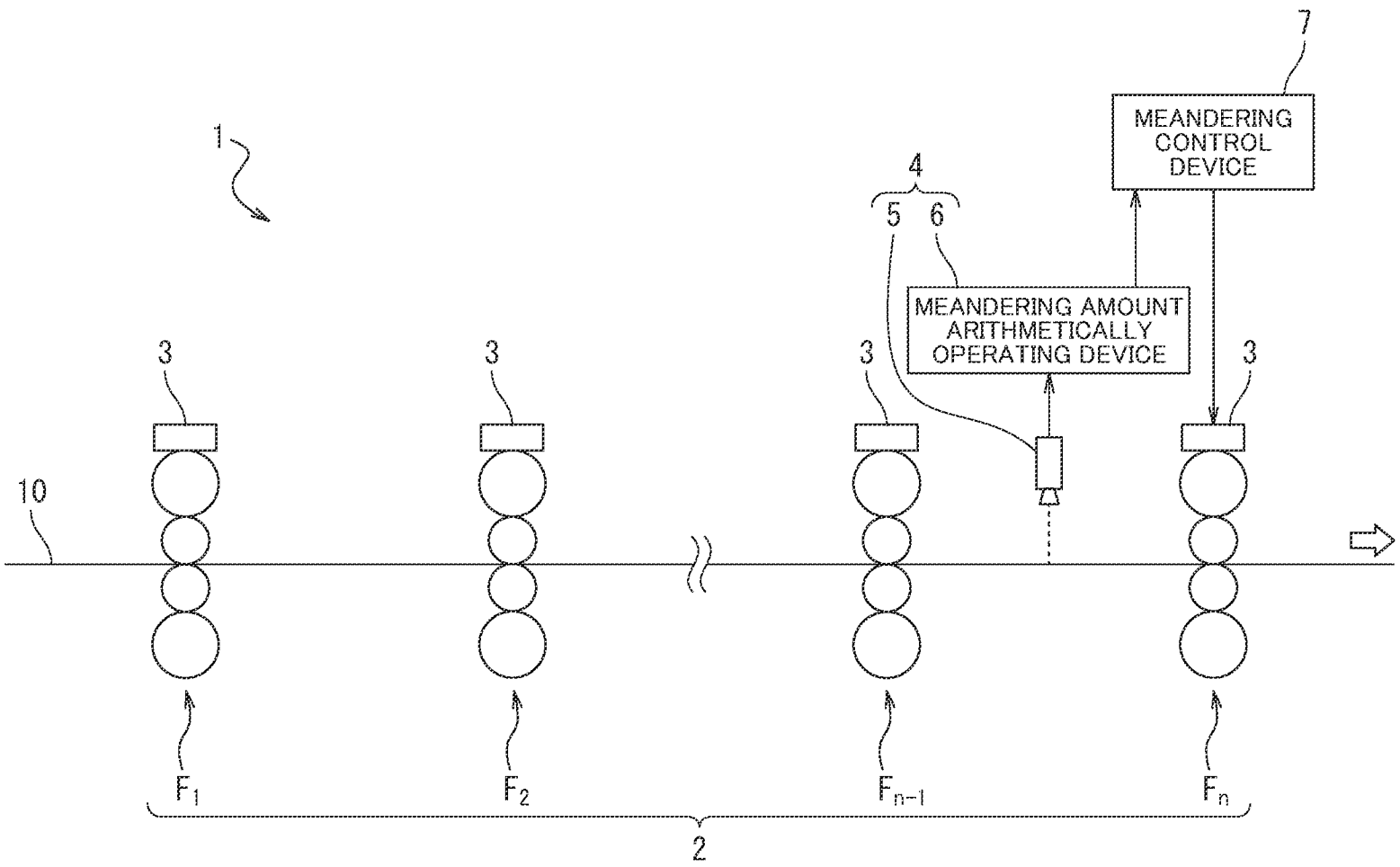
FIG. 1 is a schematic configuration view of hot-rolling equipment including a meandering amount measurement device according to an example.

1 hot-rolling equipment
2 finish rolling mill (rolling mill)
3 leveling device
4 meandering amount measurement device
5 line sensor camera (imaging device)
6 meandering amount arithmetically operating device
7 meandering control device
10 steel sheet
20 captured image
61 captured image acquisition unit
62 uncorrected edge detection unit
63 uncorrected edge holding unit
64 measurement reliability determination unit
65 sheet width updating unit
66 meandering amount calculation unit
67 output unit
F1 to Fn rolling stand

DETAILED DESCRIPTION

An example of our devices, steel strips and methods are described with reference to the drawings. The example described below exemplifies devices or methods embodying our technical concepts, and our technical ideas do not specify the materials, shapes, structures, arrangement, and the like of constituent components to the materials, shapes, structures, arrangement and the like described below. The drawings are schematic. Therefore, the relationship between the thickness and the planar dimension, ratio and the like may be different from the actual relationship, ratio and the like. The drawings include portions different in mutual dimensional relationships and ratios.

FIG. 1 illustrates the schematic configuration of hot-rolling equipment including a meandering amount measurement device according to one configuration.

In hot-rolling equipment for hot-rolled steel strip 1, a slab heated in a heating furnace (not illustrated) undergoes a rough rolling step, a finish rolling step, and a cooling step, and a steel sheet having predetermined sheet width and sheet thickness is manufactured and wound up. More specifically, the hot-rolling equipment 1 includes the heating furnace, a rough rolling mill (not illustrated), a finish rolling mill 2 (see FIG. 1), cooling equipment (not illustrated), and winding equipment (not illustrated), and a meandering amount measurement device 4 provided in the finish rolling mill 2.

In the finish rolling step, tandem rolling is performed in which a steel sheet 10 is simultaneously finish rolled in the finish rolling mill 2 illustrated in FIG. 1. The finish rolling mill 2 includes a plurality (n: n 3) of rolling stands F1 to Fn for finish rolling the steel sheet 10. Each of the rolling stands F1 to Fn is provided with a leveling device 3 for adjusting the rolling reduction amounts on the operation side and the drive side.

Each of the leveling devices 3 adjusts the rolling reduction amount by a rolling reduction device (not illustrated) attached to the operation side of each of the rolling stands F1 to Fn and the rolling reduction amount by a rolling reduction device (not illustrated) attached to the drive side of each of the rolling stands F1 to Fn.

Further, the finish rolling mill 2 includes, for performing a "Sensor type meandering control," a meandering amount measurement device 4 measuring the meandering amount of the steel sheet 10 during finish rolling by the finish rolling mill 2 and a meandering control device 7 arithmetically operating a roll opening difference, which is a roll gap opening difference, between the operation side and the drive side in the rolling stand Fn to be controlled based on the meandering amount of the steel sheet 10 calculated by the meandering amount measurement device 4, and sending the arithmetically operated roll opening difference to the leveling device 3 provided in the rolling stand Fn to be controlled.

The meandering amount measurement device 4 includes a line sensor camera 5 as an imaging device periodically imaging the surface of the steel sheet 10 during finish rolling and a meandering amount arithmetically operating device 6 calculating the meandering amount of the steel sheet 10 based on a plurality of captured images captured by the line sensor camera 5. In this configuration, the rolling stand to be controlled is the rolling stand Fn on the final stage, and the line sensor camera 5 is installed between the rolling stand Fn to be controlled and the rolling stand Fn−1 on the upstream side by one before the rolling stand Fn.

Figure 4:
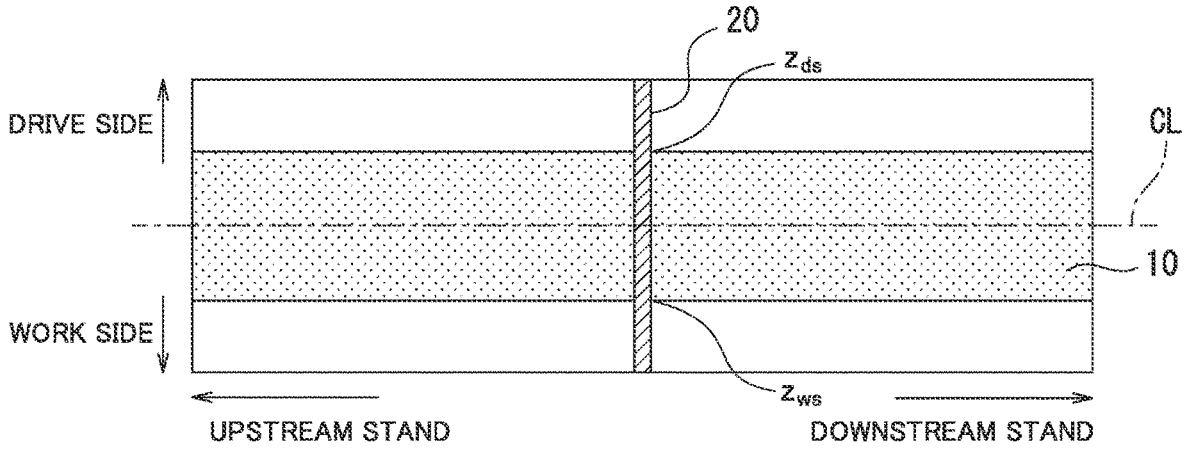
FIG. 4 is a view explaining a captured image of a line sensor camera as an imaging device of the meandering amount measurement device illustrated in FIG. 1.

The line sensor camera 5 is a one-dimensional imaging device, contains a CCD imaging sensor element and the like, and images the surface of the steel sheet 10 traveling during rolling in a manner of crossing in the width direction of the steel sheet 10 as illustrated in FIG. 4. FIG. 4 illustrates a captured image 20 by the line sensor camera 5. The line sensor camera 5 periodically images the surface of the steel sheet 10 traveling from the upstream stand side to the downstream stand side, and obtains a plurality of captured images 20 in a predetermined period.

Figure 2:
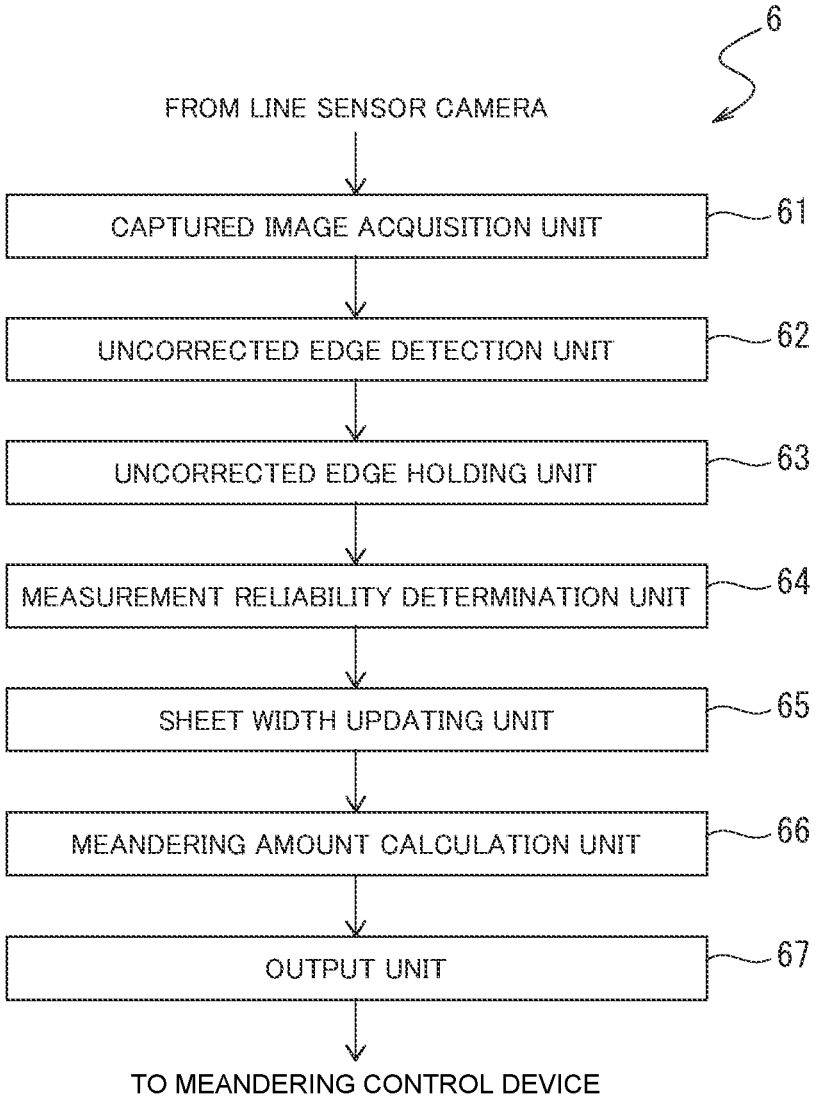
FIG. 2 is a functional block diagram of a meandering amount arithmetically operating device constituting the meandering amount measurement device illustrated in FIG. 1.

The meandering amount arithmetically operating device 6 calculates the meandering amount of the steel sheet 10 based on the plurality of captured images 20 captured by the line sensor camera 5, and includes, as illustrated in FIG. 2, a captured image acquisition unit 61, an uncorrected edge detection unit 62, an uncorrected edge holding unit 63, a measurement reliability determination unit 64, a sheet width updating unit 65, a meandering amount calculation unit 66, and an output unit 67. The meandering amount arithmetically operating device 6 is a computer system having an arithmetic processing capability, and is configured to be able to realize, on software, the functions of the captured image acquisition unit 61, the uncorrected edge detection unit 62, the uncorrected edge holding unit 63, the measurement reliability determination unit 64, the sheet width updating unit 65, the meandering amount calculation unit 66, and the output unit 67 (Step S3 to Step S9 described later) by executing various dedicated computer programs stored in advance in hardware.

The captured image acquisition unit 61 of the meandering amount arithmetically operating device 6 acquires the plurality of captured images 20 of the surface of the steel sheet 10 periodically captured by the line sensor camera 5.

The uncorrected edge detection unit 62 calculates a luminance difference between pixels adjacent to each other in the width direction of each of the plurality of captured images 20 acquired by the captured image acquisition unit 61, detects a plurality of sites where the luminance difference is maximum on the drive side in the width direction of the steel sheet 10 as a drive side edge site $z_{ds}$ of the steel sheet 10, and detects a plurality of sites where the luminance difference is maximum on the work side in the width direction of the steel sheet 10 as a work side edge site $z_{ws}$ of the steel sheet 10.

Specifically, the uncorrected edge detection unit 62 calculates the luminance difference between pixels adjacent to each other from a center part in the width direction of each of the captured images 20 (a center line CL in the width direction of the steel sheet of the captured image 20 illustrated in FIG. 4) to each of the drive side and the work side on both ends in the width direction, detects a plurality of drive side sites where the absolute value of the luminance difference is maximum as a drive side edge site $z_{ds}$ of the steel sheet 10, and detects a plurality of work side sites where the absolute value of the luminance difference is maximum as a work side edge site $z_{ws}$ of the steel sheet 10.

Figure 5:
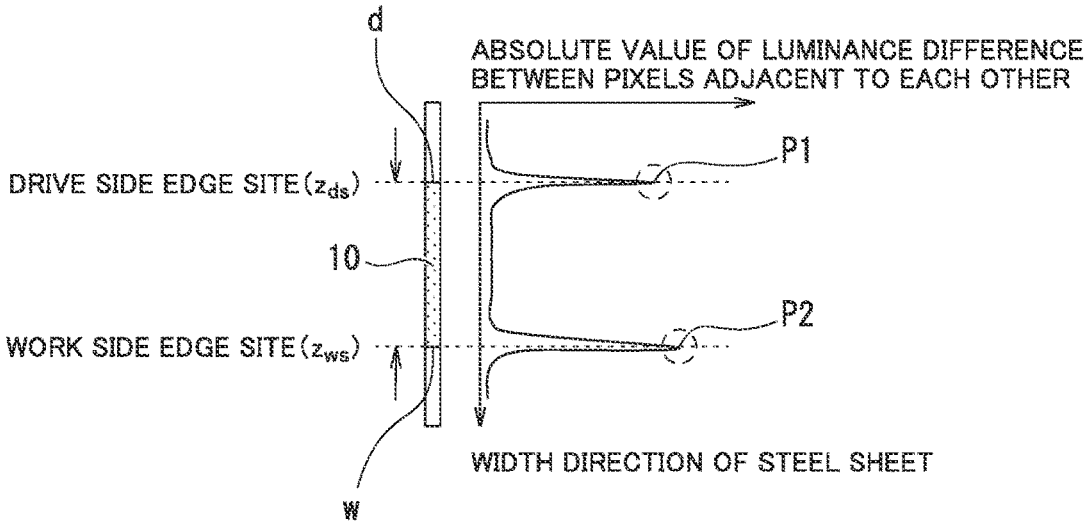
FIG. 5 is a view explaining the detection of a drive side edge site and a work side edge site of a steel sheet in an environment without vapor or fumes.

In an environment without vapor or fumes between the rolling stand Fn and the rolling stand Fn−1 where the line sensor camera 5 is installed, a drive side site (drive side edge site $z_{ds}$) indicated by P1 where the absolute value of the luminance difference between pixels adjacent to each other in the width direction is maximum coincides with an actual drive side edge site d of the steel sheet 10 as illustrated in FIG. 5. A work side site (work side edge site $z_{ws}$) indicated by P2 where the absolute value of the luminance difference of the pixels adjacent to each other in the width direction is maximum coincides with an actual work side edge site w of the steel sheet 10.

Figure 6:
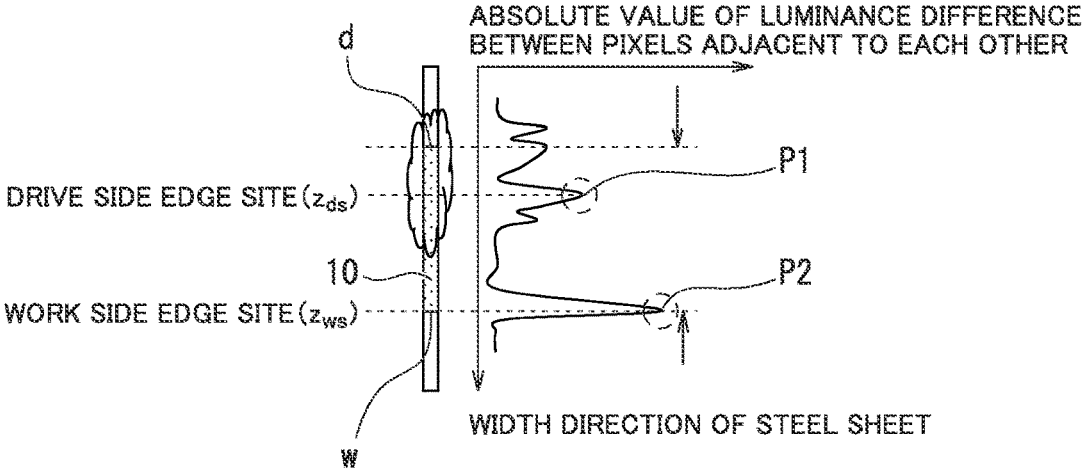
FIG. 6 is a view explaining the detection of the drive side edge site and the work side edge site of the steel sheet in an environment with vapor or fumes.

On the other hand, in an environment with vapor or fumes between the rolling stand Fn and the rolling stand Fn−1 where the line sensor camera 5 is installed, the drive side site (drive side edge site $z_{ds}$) indicated by P1 where the absolute value of the luminance difference between pixels adjacent to each other in the width direction is maximum sometimes does not sometimes coincide with the actual drive side edge site d of the steel sheet 10 as illustrated in FIG. 6. The work side site (work side edge site $z_{ws}$) indicated by P2 where the absolute value of the luminance difference of the pixels adjacent to each other in the width direction is maximum sometimes does not coincide with the actual work side edge site w of the steel sheet 10. The reason therefor is that electromagnetic waves containing a visible light and an infrared light are scattered by the vapor or the fumes.

The uncorrected edge holding unit 63 holds the plurality of drive side edge sites $z_{ds}$ and work side edge sites $z_{ws}$ of the steel sheet 10 detected by the uncorrected edge detection unit 62.

The measurement reliability determination unit 64 determines that the drive side edge site $z_{ds}(N)$ and the work side edge site $z_{ws}(N)$ at the current time have low reliability when each of the sums $\alpha_{ds}$, $\alpha_{ws}$ of change amount absolute values is equal to or larger than a predetermined threshold R, and determines that the drive side edge site $z_{ds}(N)$ and the work side edge site $z_{ws}(N)$ at the current time have high reliability when each of the sums $\alpha_{ds}$, $\alpha_{ws}$ is less than the predetermined threshold R, the sums as, $\alpha_{ws}$ being represented by Equations (1), (2) of the drive side edge sites ($z_{ds}(i)$, i=1, 2, . . . , N) and the work side edge sites ($z_{ws}(i)$, i=1, 2, . . . , N) of the steel sheet 10 detected by N times in the past including the current time extracted from the plurality of drive side edge sites $z_{ds}$ and work side edge sites $z_{ws}$, respectively, of the steel sheet 10 held by the uncorrected edge holding unit 63:

$$\alpha_{ds}=\Sigma_{i=2}^{N}|z_{dsi}-z_{dsi-1}| \quad (1)$$

$$\alpha_{ws}=\Sigma_{i=2}^{N}|z_{wsi}-z_{dwsi-1}| \quad (2)$$

More specifically, the measurement reliability determination unit 64 acquires data of the plurality drive side edge sites $z_{ds}$ and work side edge sites $z_{ws}$ of the steel sheet 10 held by the uncorrected edge holding unit 63.

Then, the measurement reliability determination unit 64 extracts the drive side edge sites ($z_{ds}(i)$, i=1, 2, . . . N) detected by N times in the past including the current time from the acquired plurality of drive side edge sites $z_{ds}$ of the steel sheet 10 and calculates the sum $\alpha_{ds}$ of the change amount absolute values represented by Equation (1) of the extracted drive side edge sites ($z_{ds}(i)$, i=1, 2, . . . N) detected by N times in the past including the current time. Similarly, the measurement reliability determination unit 64 extracts the work side edge sites ($z_{ws}(i)$, i=1, 2, . . . N) detected by N times in the past including the current time from the acquired plurality of work side edge sites $z_{ws}$ of the steel sheet 10 and calculates the sum $\alpha_{ws}$ of the change amount absolute values represented by Equation (2) of the extracted work side edge sites ($z_{ws}(i)$, i=1, 2, . . . N) detected by N times in the past including the current time.

Then, the measurement reliability determination unit 64 determines whether each of the sum $\alpha_{ds}$ of the change amount absolute values of the drive side edge sites and the sum $\alpha_{ws}$ of the change amount absolute values of the work side edge sites is equal to or larger than a predetermined threshold J. The value of the threshold 3 is set to an empirically acceptable value when the steel sheet 10 is a common steel sheet as the change amount between one edge (drive side edge) in the width direction and the other edge (work side edge) in the width direction of the steel sheet 10.

Then, the measurement reliability determination unit 64 determines that the reliability of the drive side edge site $z_{ds}(N)$ at the current time is low when the sum $\alpha_{ds}$ of the change amount absolute values of the drive side edge sites is equal to or larger than the predetermined threshold value β, and determines that the reliability of the work side edge site $z_{ws}(N)$ at the current time is low when the sum $\alpha_{ws}$ of the change amount absolute values of the work side edge sites is equal to or larger than the predetermined threshold value β. The measurement reliability determination unit 64 determines that the reliability of the drive side edge site $z_{ds}(N)$ at the current time is high when the sum $\alpha_{ds}$ of the change amount absolute values of the drive side edge sites is less than the predetermined threshold value J, and determines that the reliability of the work side edge site $z_{ws}(N)$ at the current time is high when the sum $\alpha_{ws}$ of the change amount absolute values of the work side edge sites is less than the predetermined threshold value β.

The sheet width updating unit 65 of the meandering amount arithmetically operating device 6 calculates the number of pixels W' corresponding to the sheet width calculated from both the drive side edge site $z_{ds}(N)$ and the work side edge site $z_{ws}(N)$ at the current time and updates the number of pixels W (The initial value of W is the number of pixels to the set sheet width.) corresponding to the sheet width to the calculated W' when the measurement reliability determination unit 64 determines that both the drive side edge site $z_{ds}(N)$ and the work side edge site $z_{ws}(N)$ at the current time have high reliability. The sheet width updating unit 65 leaves the number of pixels W corresponding to the sheet width as the number of pixels W when the measurement reliability determination unit 64 determines that at least one of the drive side edge site $z_{ds}(N)$ and the work side edge site $z_{ws}(N)$ at the current time has low reliability. The number of pixels to the set sheet width, which is the initial value of W, is sent from a host computer (not illustrated) to the sheet width updating unit 65 of the meandering amount arithmetically operating device 6.

The meandering amount calculation unit 66 calculates the meandering amount of the steel sheet 10 using the drive side edge site $z_{ds}(N)$ and the work side edge site $z_{ws}(N)$ at the current time detected by the uncorrected edge detection unit 62, the reliability evaluation results of the drive side edge site $z_{ds}(N)$ and the work side edge site $z_{ws}(N)$ at the current time by the measurement reliability determination unit 64, and the number of pixels W corresponding to the sheet width held by the sheet width updating unit 65.

Specifically, as shown in Table 1, the meandering amount calculation unit 66 calculates the meandering amount of the steel sheet using the drive side edge site $z_{ds}(N)$ and the work side edge site $z_{ws}(N)$ at the current time when the measurement reliability determination unit 64 determines that both the drive side edge site $z_{ds}(N)$ and the work side edge site $z_{ws}(N)$ at the current time have high reliability (Case 1). Specifically, in Case 1, the meandering amount calculation unit 66 calculates an average value=$(z_{ds}(N)+z_{ws}(N))/2$ of $z_{ds}(N)$ and $z_{ws}(N)$ as the meandering amount of the steel sheet 10 because the coordinate amount in the center part of the steel sheet 10 is the meandering amount when the mill center coordinate is set to 0.

TABLE 1

| | Reliability | | |
|---|---|---|---|
| Case | Drive side edge site ($z_{ds}(N)$) | Work side edge site ($z_{ws}(N)$) | Meandering amount calculation method (The mill center coordinate is set to 0.) |
| 1 | High | High | Meandering amount: $(z_{ds}(N) + z_{ws}(N))/2$ |
| 2 | High | Low | Meandering amount: $z_{ds}(N) + W^*x/2$ |
| 3 | Low | High | Meandering amount: $z_{ws}(N) - W^*x/2$ |
| 4 | Low | Low | Meandering amount: — (None) |

When the measurement reliability determination unit 64 determines that only one of the drive side edge site $z_{ds}(N)$ and the work side edge site $z_{ws}(N)$ at the current time has high reliability (Cases 2 and 3), the meandering amount calculation unit 66 calculates by interpolation the other side edge site using the number of pixels W from the sheet width updating unit 65 with the drive side edge site $z_{ds}(N)$ or the work side edge site $z_{ws}(N)$ at the current time having high reliability as a reference and calculates the meandering amount of the steel sheet 10 using the drive side edge site $z_{ds}(N)$ or the work side edge site $z_{ws}(N)$ at the current time having high reliability and the other side edge site subjected to the calculation by interpolation as shown in Table 1.

More specifically, when only the drive side edge site $z_{ds}(N)$ at the current time is determined to have high reliability (Case 2), the meandering amount calculation unit 66 calculates by interpolation the other side edge site using the number of pixels W from the sheet width updating unit 65 with the drive side edge site $z_{ds}(N)$ at the current time having high reliability as a reference and calculates the meandering amount of the steel sheet 10 using the drive side edge site $z_{ds}(N)$ at the current time having high reliability and the other side edge site subjected to the calculation by interpolation as shown in Table 1. In Case 2, the meandering amount of the steel sheet 10 is calculated as $z_{ds}(N)+W\times x/2$ assuming that the center part of the steel sheet 10 is a part where ½ of a value obtained by multiplying the number of pixels W corresponding to the sheet width by a length x per pixel is added to the drive side edge site $z_{ds}(N)$ at the current time having high reliability. The mill center coordinate is 0.

When only the work side edge site $z_{ws}(N)$ at the current time is determined to have high reliability (Case 3), the meandering amount calculation unit 66 calculates by interpolation the other side edge site using the number of pixels W from the sheet width updating unit 65 with the work side edge site $z_{ws}(N)$ at the current time having high reliability as a reference and calculates the meandering amount of the steel sheet 10 using the work side edge site $z_{ws}(N)$ at the current time having high reliability and the other side edge site subjected to the calculation by interpolation as shown in Table 1. In Case 3, the meandering amount of the steel sheet 10 is calculated as $z_{ws}(N)-W\times x/2$ assuming that the center part of the steel sheet 10 is a part where ½ of a value obtained by multiplying the number of pixels W corresponding to the sheet width by a length x per pixel is subtracted from the work side edge site $z_{ws}(N)$ at the current time having high reliability. The mill center coordinate is 0.

When the measurement reliability determination unit 64 determines that both the drive side edge site $z_{ds}(N)$ and the work side edge site $z_{ws}(N)$ at the current time have low reliability (Case 4), the meandering amount calculation unit 66 does not calculate the meandering amount of the steel sheet 10 as shown in Table 1.

The output unit 67 of the meandering amount arithmetically operating device 6 sends the meandering amount of the steel sheet 10 calculated by the meandering amount calculation unit 66 to the meandering control device 7.

The meandering control device 7 arithmetically operates the roll opening difference, which is the roll gap opening difference, between the operation side and the drive side in the rolling stand Fn to be controlled based on the meandering amount of the steel sheet 10 from the output unit 67 of the meandering amount arithmetically operating device 6 and sends the arithmetically operated roll opening difference to the leveling device 3 provided in the rolling stand Fn to be controlled.

The leveling device 3 adjusts the rolling reduction amount by the rolling reduction device attached to the operation side of the rolling stand Fn to be controlled and the rolling reduction amount by the rolling reduction device attached to the drive side of the rolling stand Fn based on the roll opening difference sent from the meandering control device 7 such that the roll opening difference of the rolling stand Fn to be controlled is equal to the roll opening difference sent from the meandering control device 7. Thus, the leveling amount of the rolling stand Fn to be controlled is changed in proportion to the meandering amount of the steel sheet 10, and the meandering amount of the steel sheet 10 is reduced.

Thus, according to the steel-sheet meandering amount measurement device 4 of this configuration, the meandering amount arithmetically operating device 6 includes the measurement reliability determination unit 64 determining that the drive side edge site $z_{ds}(N)$ and the work side edge site $z_{ws}(N)$ at the current time have low reliability when each of the sums $\alpha_{ds}$, $\alpha_{ws}$ of the change amount absolute values is equal to or larger than the predetermined threshold, and determining that the drive side edge site $z_{ds}(N)$ and the work side edge site $z_{ws}(N)$ at the current time have high reliability when each of the sums $\alpha_{ds}$, $\alpha_{ws}$ is less than the predetermined threshold, the sums $\alpha_{ds}$, $\alpha_{ws}$ being represented by Equations (1), (2) of the drive side edge sites ($z_{ds}(i)$, i=1, 2, . . . , N) and the work side edge sites ($z_{ws}(i)$, i=1, 2, . . . , N) respectively, detected by N times in the past including the current time. The meandering amount arithmetically operating device 6 further includes the meandering amount calculation unit 66 calculating the meandering amount of the steel sheet 10 using the drive side edge site $z_{ds}(N)$ and the work side edge site $z_{ws}(N)$ at the current time when the measurement reliability determination unit 64 determines that both the drive side edge site $z_{ds}(N)$ and the work side edge site $z_{ws}(N)$ at the current time have high reliability, calculating by interpolation the other side edge site using the number of pixels W from the sheet width updating unit 65 with the drive side edge site $z_{ds}(N)$ or the work side edge site $z_{ws}(N)$ at the current time having high reliability as a reference and calculating the meandering amount of the steel sheet 10 using the drive side edge site $z_{ds}(N)$ or the work side edge site $z_{ws}(N)$ at the current time having high reliability and the other side edge site subjected to the calculation by interpolation when the measurement reliability determination unit 64 determines that only one of the drive side edge site $z_{ds}(N)$ and the work side edge site $z_{ws}(N)$ at the current time has high reliability, and not calculating the meandering amount of the steel sheet 10 when the measurement reliability determination unit 64 determines that both the drive side edge site $z_{ds}(N)$ and the work side edge site $z_{ws}(N)$ at the current time have low reliability.

Thus, the steel-sheet meandering amount measurement device 4 can be provided which can exactly measure the waking amount of the steel sheet 10, not only when both the edges of the steel sheet 10 can be detected but even when one edge of the steel sheet 10 cannot be detected because the edge is covered with vapor or fumes while the other edge of the steel sheet 10 can be detected because the edge is not covered with vapor or fumes in measuring the meandering amount of the steel sheet during rolling.

Further, the meandering amount arithmetically operating device 6 includes the output unit 67 outputting the meandering amount of the steel sheet 10 calculated by the meandering amount calculation unit 66 to the meandering control device 7. Thus, the meandering control device 7 can appropriately control the leveling of the rolling stand Fn to be controlled based on the meandering amount measured by the meandering amount measurement device 4.

The hot-rolling equipment for hot-rolled steel strip 1 according to this configuration further includes the meandering amount measurement device 4. Thus, the hot-rolling equipment for hot-rolled steel strip 1 can be provided which can exactly measure the meandering amount of the steel sheet 10 in measuring the meandering amount of the steel sheet during rolling, not only when both the edges of the steel sheet 10 can be detected but even when one edge of the steel sheet 10 cannot be detected because the edge is covered with vapor or fumes while the other edge of the steel sheet 10 can be detected because the edge is not covered with vapor or fumes.

Figure 3:
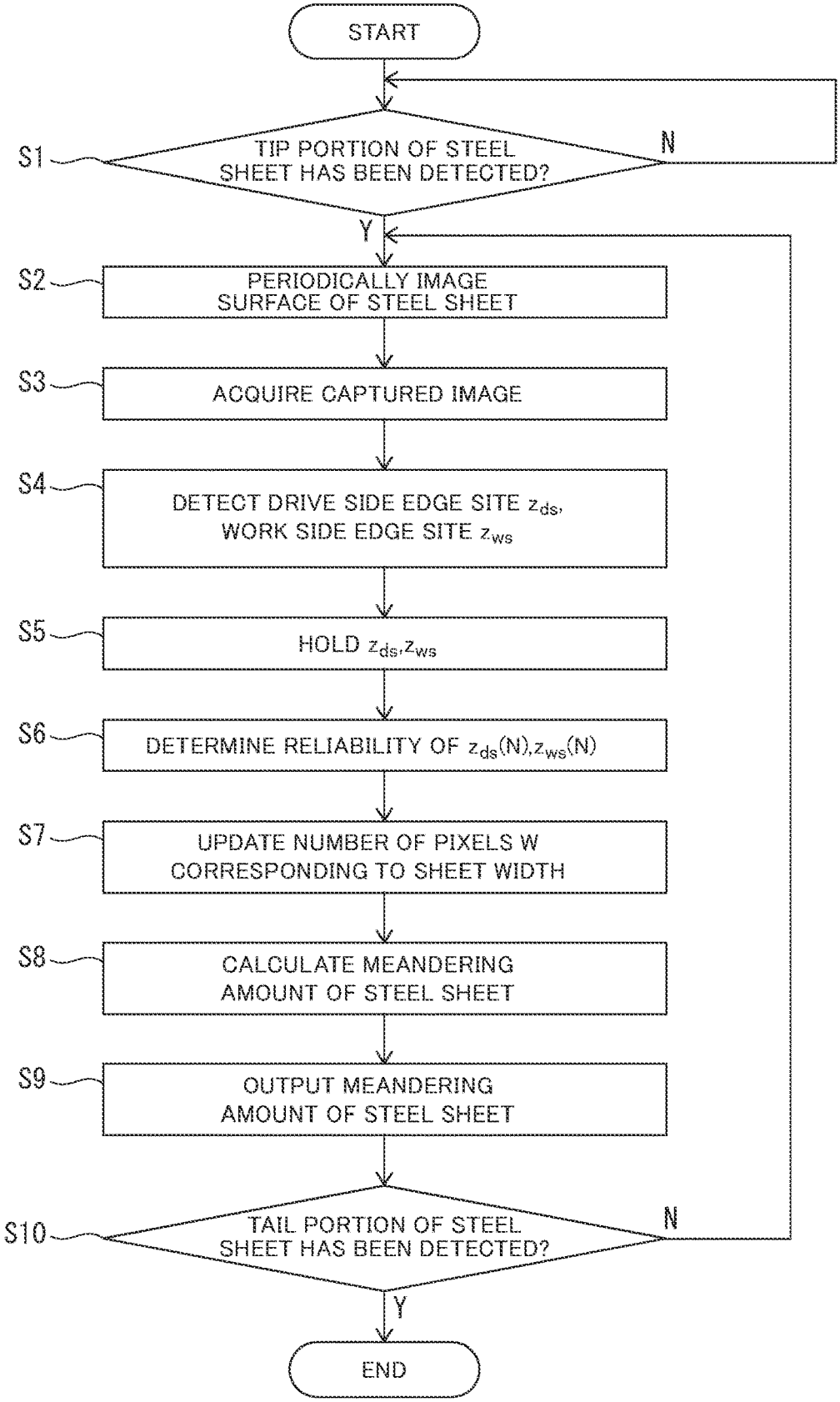
FIG. 3 is a flow chart illustrating the flow of processing by the meandering amount measurement device illustrated in FIG. 1.

Next, the flow of processing by the meandering amount measurement device 4 indicating the meandering amount measurement method according to one example is described with reference to the flowchart illustrated in FIG. 3.

First, the finish rolling of the steel sheet 10 is started, and Step S1 determines whether the line sensor camera 5 has detected a tip portion of the steel sheet 10. The line sensor camera 5 is provided with a steel sheet detection sensor (not illustrated) detecting the tip portion and a tail portion of the steel sheet 10.

Then, when the determination result by the line sensor camera 5 is YES (when the tip portion has been detected), the process proceeds to Step S2. When the determination result is No (when the tip portion has not been detected), the process returns to Step S1.

In Step S2, the line sensor camera 5 periodically images the surface of the steel sheet 10 traveling during rolling in a manner crossing in the width direction of the steel sheet 10 (imaging step).

Next, the process proceeds to Step S3. The captured image acquisition unit 61 of the meandering amount arithmetically operating device 6 acquires a plurality of captured images 20 of the surface of the steel sheet 10 periodically captured by the line sensor camera 5 (captured image acquisition step).

Next, the process proceeds to Step S4. The uncorrected edge detection unit 62 calculates the luminance difference between pixels adjacent to each other in the width direction of each of the plurality of captured images 20 acquired in Step S3, detects a site where the luminance difference is maximum on the drive side in the width direction of the steel sheet 10 as the drive side edge site $z_{ds}$ of the steel sheet 10, and detects a site where the luminance difference is maximum on the work side in the width direction of the steel sheet 10 as the work side edge site $z_{ws}$ of the steel sheet 10 (uncorrected edge detection step).

Next, the process proceeds to Step S5. The uncorrected edge holding unit 63 holds a plurality of drive side edge sites $z_{ds}$ and work side edge sites $z_{ws}$ detected in Step S4 (uncorrected edge holding step).

Then, the process proceeds to Step S6. The measurement reliability determination unit 64 determines that the drive side edge site $z_{ds}(N)$ and the work side edge site $z_{ws}(N)$ at the current time have low reliability when each of the sums $\alpha_{ds}$, $\alpha_{ws}$ of the change amount absolute values is equal to or larger than the predetermined threshold R, and determines that the drive side edge site $z_{ds}(N)$ and the work side edge site $z_{ws}(N)$ at a current time have high reliability when each of the sums $\alpha_{ds}$, $\alpha_{ws}$ is less than the predetermined threshold R, the sums $\alpha_{ds}$, $\alpha_{ws}$ being represented by Equations (1), (2) of the drive side edge sites ($z_{ds}(i)$, i=1, 2, . . . , N) and the work side edge sites ($z_{ws}(i)$, i=1, 2, . . . , N) of the steel sheet 10 detected by N times in the past including the current time extracted from the plurality of drive side edge sites $z_{ds}$ and work side edge sites $z_{ws}$, respectively, of the steel sheet 10 held in Step S5 (measurement reliability determination step).

Next, the process proceeds to Step S7. The sheet width updating unit 65 calculates the number of pixels W' corresponding to the sheet width calculated from both the drive side edge site $z_{ds}(N)$ and the work side edge site $z_{ws}(N)$ at the current time and updates the number of pixels W (The initial value of W is the number of pixels to the set sheet width.) corresponding to the sheet width to the calculated W' when Step S6 determines that both the drive side edge site $z_{ds}(N)$ and the work side edge site $z_{ws}(N)$ at the current time have high reliability. The sheet width updating unit 65 leaves the number of pixels W corresponding to the sheet width as the number of pixels W when Step S6 determines that at least one of the drive side edge site $z_{ds}(N)$ and the work side edge site $z_{ws}(N)$ at the current time has low reliability (sheet width updating step).

Then, the process proceeds to Step S8. When Step S6 determines that both the drive side edge site $z_{ds}(N)$ and the work side edge site $z_{ws}(N)$ at the current time have high reliability, the meandering amount calculation unit 66 calculates the meandering amount of the steel sheet 10 using the drive side edge site $z_{ds}(N)$ and the work side edge site $z_{ws}(N)$ at the current time. When Step S7 determines that only one of the drive side edge site $z_{ds}(N)$ and the work side edge site $z_{ws}(N)$ at the current time have high reliability, the meandering amount calculation unit 66 calculates by interpolation the other side edge site using the number of pixels W from Step S6 with the drive side edge site $z_{ds}(N)$ or the work side edge site $z_{ws}(N)$ at the current time having high reliability as a reference and calculates the meandering amount of the steel sheet 10 using the drive side edge site $z_{ds}(N)$ or the work side edge site $z_{ws}(N)$ at the current time having high reliability and the other side edge site subjected to the calculation by interpolation. When Step S6 determines that both the drive side edge site $z_{ds}(N)$ and the work side edge site $z_{ws}(N)$ at the current time have low reliability, the meandering amount calculation unit 66 does not calculate the meandering amount of the steel sheet 10 (meandering amount calculation step).

Then, the process proceeds to Step S9. The output unit 67 of the meandering amount arithmetically operating device 6 sends the meandering amount of the steel sheet 10 calculated in Step S8 to the meandering control device 7 (output step).

Finally, the process proceeds to Step S10. The line sensor camera 5 determines whether the tail portion of the steel sheet 10 has been detected.

Then, when the determination result by the line sensor camera 5 is YES (when the tail portion has been detected), the processing is ended. When the determination result is No (when the tail portion has not been detected), the process returns to Step S2.

Thus, the processing by the meandering amount measurement device 4 is ended.

As described above, according to the meandering amount measurement method of this example, the measurement reliability determination step (Step S6) determines that the drive side edge site $z_{ds}(N)$ and the work side edge site $z_{ws}(N)$ at the current time have low reliability when each of the sums $\alpha_{ds}$, $\alpha_{ws}$ of the change amount absolute values is equal to or larger than the predetermined threshold, and determines that the drive side edge site $z_{ds}(N)$ and the work side edge site $z_{ws}(N)$ at the current time have high reliability when each of the sums $\alpha_{ds}$, $\alpha_{ws}$ is less than the predetermined threshold, the sums $\alpha_{ds}$, $\alpha_{ws}$ being represented by Equations (1), (2) of the drive side edge sites ($z_{ds}(i)$, i=1, 2, . . . , N) and the work side edge sites ($z_{ws}(i)$, i=1, 2, . . . , N), respectively, detected by N times in the past including the current time. According to the meandering amount measurement method, when the measurement reliability determination step (Step S6) determines that both the drive side edge site $z_{ds}(N)$ and the work side edge site $z_{ws}(N)$ at the current time have high reliability, the meandering amount calculation step (Step S8) calculates the meandering amount of the steel sheet 10 using the drive side edge site $z_{ds}(N)$ and the work side edge site $z_{ws}(N)$ at the current time. When the measurement reliability determination step (Step S6) determines that only one of the drive side edge site $z_{ds}(N)$ and the work side edge site $z_{ws}(N)$ at the current time has high reliability, the meandering amount calculation step (Step S8) calculates by interpolation the other side edge site using the number of pixels W from the sheet width updating unit 65 with the drive side edge site $z_{ds}(N)$ or the work side edge site $z_{ws}(N)$ at the current time having high reliability as a reference and calculates the meandering amount of the steel sheet 10 using the drive side edge site $z_{ds}(N)$ or the work side edge site $z_{ws}(N)$ at the current time having high reliability and the other side edge site subjected to the calculation by interpolation. When the measurement reliability determination step (Step S6) determines that both the drive side edge site $z_{ds}(N)$ and the work side edge site $z_{ws}(N)$ at the current time have low reliability, the meandering amount calculation step (Step S8) does not calculate the meandering amount of the steel sheet 10.

Thus, the steel-sheet meandering amount measurement method can be provided which can exactly measure the meandering amount of the steel sheet 10 in measuring the meandering amount of the steel sheet during rolling, not only when both the edges of the steel sheet 10 can be detected but even when one edge of the steel sheet 10 cannot be detected because the edge is covered with vapor or fumes while the other edge of the steel sheet 10 can be detected because the edge is not covered with vapor or fumes.

Further, the meandering amount measurement method according to this example includes the output step of outputting the meandering amount of the steel sheet 10 calculated in the meandering amount calculation step (Step S8) to the meandering control device (Step S9). Thus, the meandering control device 7 can appropriately control the leveling of the rolling stand Fn to be controlled based on the meandering amount measured in the meandering amount measurement step.

Further, the hot-rolling method of hot-rolled steel strip according to this example includes the step of measuring the meandering amount of the steel sheet 10 during rolling by the finish rolling mill 2 having the plurality of rolling stands F1 to Fn according to this meandering amount measurement method. Thus, the hot-rolling method of hot-rolled steel strip can be provided which can exactly measure the meandering amount of the steel sheet 10 in measuring the meandering amount of the steel sheet during rolling, not only when both the edges of the steel sheet 10 can be detected but even when one edge of the steel sheet 10 cannot be detected because the edge is covered with vapor or fumes while the other edge of the steel sheet 10 can be detected because the edge is not covered with vapor or fumes.

Although the example is described above, this disclosure is not limited thereto and can be variously altered and modified.

For example, the imaging device does not need to be the line sensor camera 5 but may be an area sensor camera.

When the luminance difference between pixels adjacent to each other in the width direction of the captured image 20 is calculated in the uncorrected edge detection unit 62 (pre-correction detection step), in addition to when the luminance difference between pixels adjacent to each other is calculated from the center part in the width direction to each of the drive side and the work side on both ends in the width direction of each of the captured images 20, the luminance difference between pixels adjacent to each other may be calculated from the work side on one end in the width direction of the captured images 20 to the center part in the width direction and to the drive side on one end in the width direction of the captured image 20.

The sheet width updating unit (sheet width updating step) 65 may be configured such that, when the number of pixels W' corresponding to the sheet width is calculated from both the drive side edge site $z_{ds}(N)$ and the work side edge site $z_{ws}(N)$ at the current time and the calculated W' is within the preset upper and lower limit range, the sheet width updating unit (sheet width updating step) 65 updates the number of pixels W corresponding to the sheet width to the calculated W', and that, when the calculated W' is out of the preset upper and lower limit range, the sheet width updating unit (sheet width updating step) 65 leaves the number of pixels W corresponding to the sheet width as the number of pixels W. Thus, when the number of pixels W' calculated in the sheet width updating unit (sheet width updating step) 65 deviates from the number of pixels corresponding to the regular sheet width of the steel sheet 10, the sheet width updating operation becomes unnecessary so that the processing time in the meandering amount calculation processing can be shortened. The "preset upper and lower limit range" means the upper and lower limit range of the number of pixels corresponding to the regular sheet width of the steel sheet 10.

The line sensor camera 5 as the imaging device is installed between the rolling stand Fn to be controlled and the rolling stand Fn−1 on the upstream side by one before the rolling stand Fn, but our devices are not limited thereto. The line sensor camera 5 may be installed between any rolling stands such as between the stands F1 and F2 adjacent to each other, between the stands F2 and F3 adjacent to each other, . . . , between the stands Fn−1 and Fn adjacent to each other.

The meandering amount measurement device 4 and the meandering amount measurement method according to this example are applied in measuring the meandering amount of the steel sheet 10 during rolling by the finish rolling mill 2 of the hot-rolling equipment 1 but may be applied in measuring the meandering amount of a steel sheet during rolling with a continuous cold rolling mill of cold rolling equipment.

Examples

We finish rolled the steel sheet 10 using hot-rolling equipment 1 having seven rolling stands F1 to F7, periodically imaged the surface of the steel sheet 10 by the line sensor camera 5 installed between the rolling stand F6 and the rolling stand F7 to be controlled at that time, and then calculated, by the meandering amount arithmetically operating device 6, the meandering amount of the steel sheet 10 in a Comparative Example and an Example based on the plurality of captured images 20 captured by the line sensor camera 5.

Figure 7:
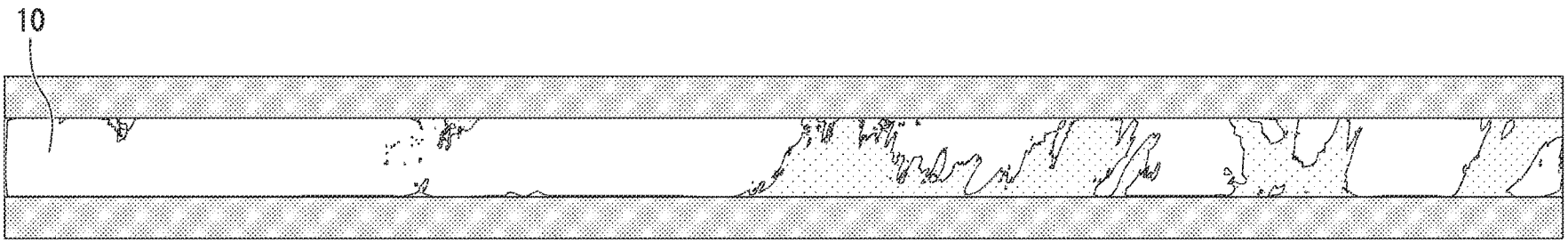
FIG. 7 is a view illustrating a two-dimensional image obtained by connecting a plurality of captured images periodically captured by the line sensor camera along the longitudinal direction of the steel sheet in an Example and a Comparative Example.

FIG. 7 illustrates a two-dimensional image obtained by connecting the plurality of captured images 20 periodically captured by the line sensor camera 5 along the longitudinal direction of the steel sheet 10. In the two-dimensional image illustrated in FIG. 7, water vapor present on the surface of the steel sheet 10 looks like clouds. On the surface of the steel sheet 10, water vapor or fumes are present not only in winter but also in summer. We enable the exact measurement of the meandering amount of the steel sheet, not only in winter but in summer, and even when one edge of the steel sheet 10 cannot be detected because the one edge is covered with vapor or the like while the other edge of the steel sheet 10 can be detected because the other edge is not covered with vapor or the like.

For this two-dimensional image, the meandering amount of the steel sheet 10 was calculated in the Comparative Example and the Example.

In the Comparative Example, the meandering amount of the steel sheet 10 was calculated in the following steps:

Step 1: The luminance difference between pixels adjacent to each other in the width direction of the two-dimensional image was calculated, a plurality of sites where the absolute value of the luminance difference is maximum on the drive side in the width direction of the steel sheet 10 was detected as the drive side edge site $z_{ds}$ of the steel sheet 10, and a plurality of sites where the absolute value of the luminance difference is maximum on the work side in the width direction of the steel sheet 10 was detected as the work side edge site $z_{ws}$ of the steel sheet.

Step 2: The drive side edge sites ($z_{ds}$(i), i=1, 2, . . . , 100) and the work side edge sites ($z_{ws}$(i), i=1, 2, . . . , 100) detected by 100 times in the past including the current time were individually subjected to regression, an approximate straight line of each of the drive side edge sites ($z_{ds}$(i), i=1, 2, . . . , 100) and the work side edge sites ($z_{ws}$(i), i=1, 2, . . . , 100) was obtained, and the drive side edge site and the work side edge site at the current time were estimated from the approximate straight lines.

Step 3: The meandering amount of the steel sheet 10 was calculated using the drive side edge site and the work side edge site at the current time estimated in Step 2.

In our Example, the meandering amount of the steel sheet 10 was calculated in the following steps:

Step 1: The luminance difference between pixels adjacent to each other in the width direction of the two-dimensional image was calculated, a plurality of sites where the absolute value of the luminance difference is maximum on the drive side in the width direction of the steel sheet 10 was detected as the drive side edge site $z_{ds}$ of the steel sheet 10, and a plurality of sites where the absolute value of the luminance difference is maximum on the work side in the width direction of the steel sheet 10 was detected as the work side edge site $z_{ws}$ of the steel sheet.

Step 2: When each of the sums $\alpha_{ds}$, $\alpha_{ws}$ of the change amount absolute values was equal to or larger than the predetermined threshold 3, the drive side edge site $z_{ds}$(N) and the work side edge site $z_{ws}$(N) at the current time were determined to have low reliability and, when each of the sums $\alpha_{ds}$, $\alpha_{ws}$ of the change amount absolute values was less than the predetermined threshold J, the drive side edge site $z_{ds}$(N) and the work side edge site $z_{ws}$(N) at the current time were determined to have high reliability, the sums $\alpha_{ds}$, $\alpha_{ws}$ being represented by Equations (1), (2) of the drive side edge sites ($z_{ds}$(i), i=1, 2, . . . , N=20) and the work side edge sites ($z_{ws}$(i), i=1, 2, . . . , N=20), respectively, detected by 20 times in the past including the current time. β was set to 30 px (number of pixels)×Length (2 mm) per 1 px (1 pixel)=60 mm. In β, the preferable number of pixels is 5 or more and 100 or less, and the more preferable number of pixels is 10 or more and 50 or less.

Step 3: When Step 2 determined that both the drive side edge site $z_{ds}$ (20) and the work side edge site $z_{ws}$ (20) at the current time had high reliability, the number of pixels W' corresponding to the sheet width calculated from both the drive side edge site $z_{ds}$ (20) and the work side edge site $z_{ws}$ (20) at the current time was calculated and the number of pixels W corresponding to the sheet width was updated to the calculated W' and, when Step 2 determined that at least one of the drive side edge site $z_{ds}$ (20) and the work side edge site $z_{ws}$ (20) at the current time had low reliability, the number of pixels W corresponding to the sheet width was left as the number of pixels W.

Step 4: When Step 2 determined that both the drive side edge site $z_{ds}$ (20) and the work side edge site $z_{ws}$ (20) at the current time had high reliability, the meandering amount of the steel sheet 10 was calculated using the drive side edge site $z_{ds}$ (20) and the work side edge site $z_{ws}$ (20) at the current time, when Step 2 determined that only one of the drive side edge site $z_{ds}$ (20) and the work side edge site $z_{ws}$ (20) at the current time had high reliability, the other side edge site was calculated by interpolation using the number of pixels W from Step 3 with the drive side edge site $z_{ds}$ (20) or the work side edge site $z_{ws}$ (20) at the current time having high reliability as a reference and the meandering amount of the steel sheet 10 was calculated using the drive side edge site $z_{ds}$ (20) or the work side edge site $z_{ws}$ (20) at the current time having high reliability and the other side edge site subjected to the calculation by interpolation, and, when Step 2 determined that both the drive side edge site $z_{ds}$ (20) and the work side edge site $z_{ws}$ (20) at the current time had low reliability, the meandering amount of the steel sheet 10 was not calculated.

Figure 8:
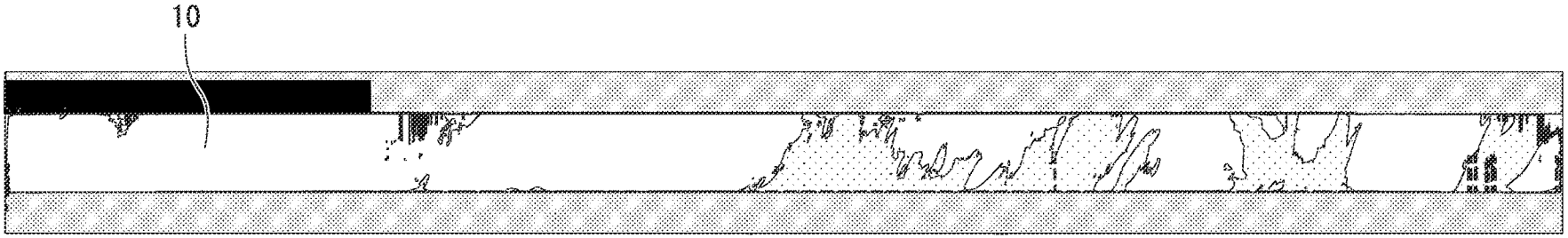
FIG. 8 illustrates a state in which a luminance difference between pixels adjacent to each other in the width direction of the steel sheet is calculated from the state illustrated in FIG. 7, and sites where an absolute value of the luminance difference is maximum are detected as drive side edge sites and work side edge sites in an Example and a Comparative Example.

In the Comparative Example and our Example, Step 1 was carried out to detect the drive side edge sites and the work side edge sites of the steel sheet 10. Then, the drive side edge sites are indicated by the solid line and the work side edge sites are indicated by the dashed line as illustrated in FIG. 8. As understood from FIG. 8, the detected drive side edge sites and work side edge sites are not limited to the edges of the steel sheet 10 but are sometimes located inside the steel sheet 10 due to the strong influence of vapor.

Figure 9A:
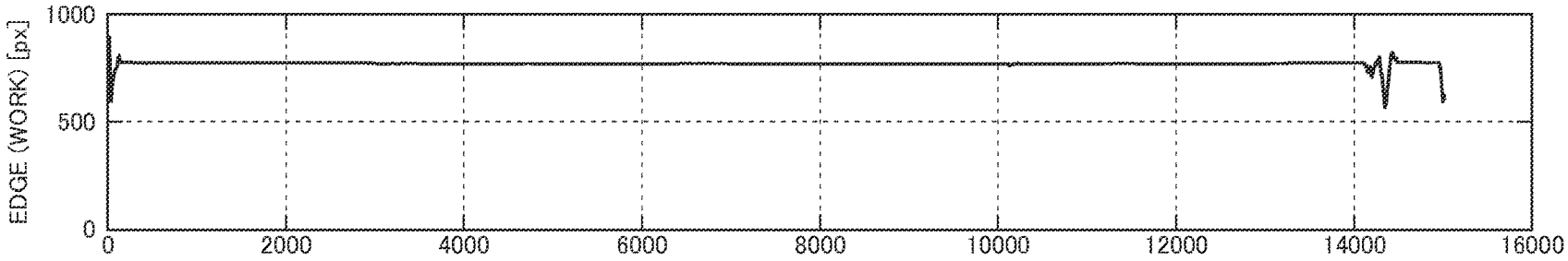
Figure 9B:
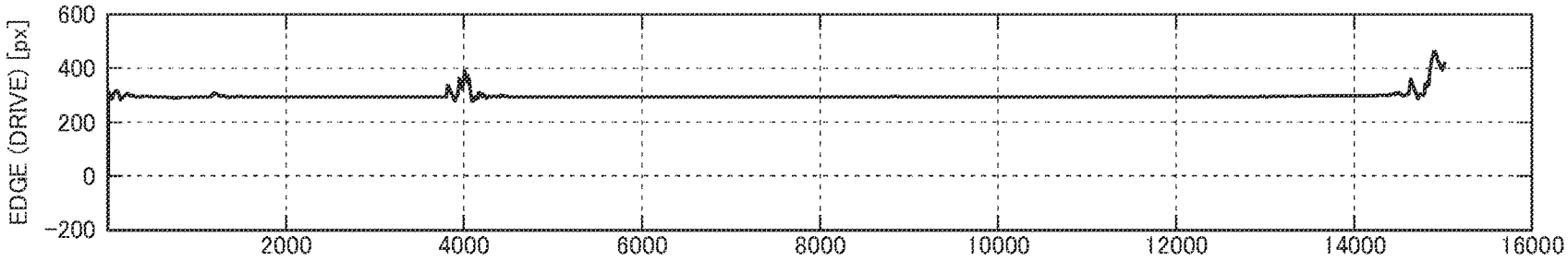
Figure 9C:
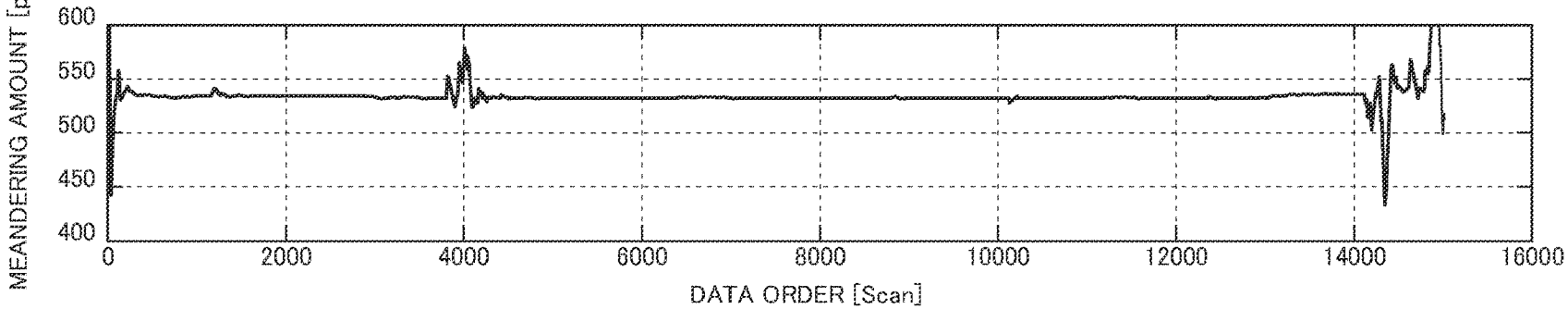

FIGS. 9A to 9C illustrate the results of calculating the meandering amount of the steel sheet 10 using the Comparative Example. In FIGS. 9A to 9C, the unit of the drive side edge sites, the work side edge sites, and the meandering amount are expressed by px (number of pixels). As illustrated in FIG. 9C, the measured value of the meandering amount fluctuates by about 50 px near about 4000 in the data order in the Comparative Example. This is because the estimation of the drive side edge site of the steel sheet 10 near about 4000 in the data order was poor as illustrated in FIG. 9B. When the fluctuated meandering amount is output to the meandering control device 7 and the leveling control is performed, the leveling setting in the rolling stand F7 to be controlled becomes defective so that the meandering of the steel sheet 10 is promoted. Even when the number of past data used for the regression was changed from 100 to other values, good results were not obtained. Further, the tail portion in and after the data order of 14000 is also strongly influenced by the vapor.

Therefore, in the Comparative Example, the meandering amount of the steel sheet 10 was not able to be exactly measured in measuring the meandering amount of the steel sheet 10 during rolling when one edge (drive side edge) of the steel sheet 10 was not able to be detected because the edge was covered with vapor or fumes while the other edge (work side edge) of the steel sheet 10 was able to be detected because the edge was not covered with vapor or fumes.

Figure 10A:
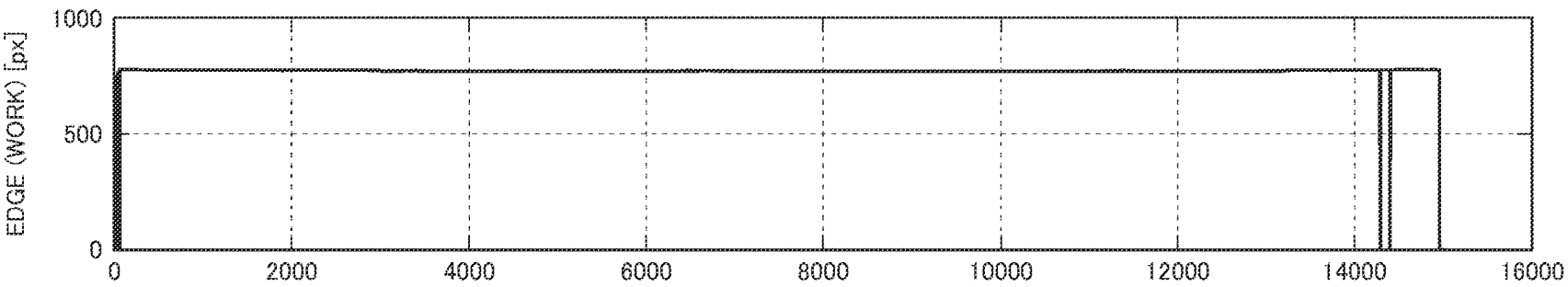
Figure 10B:
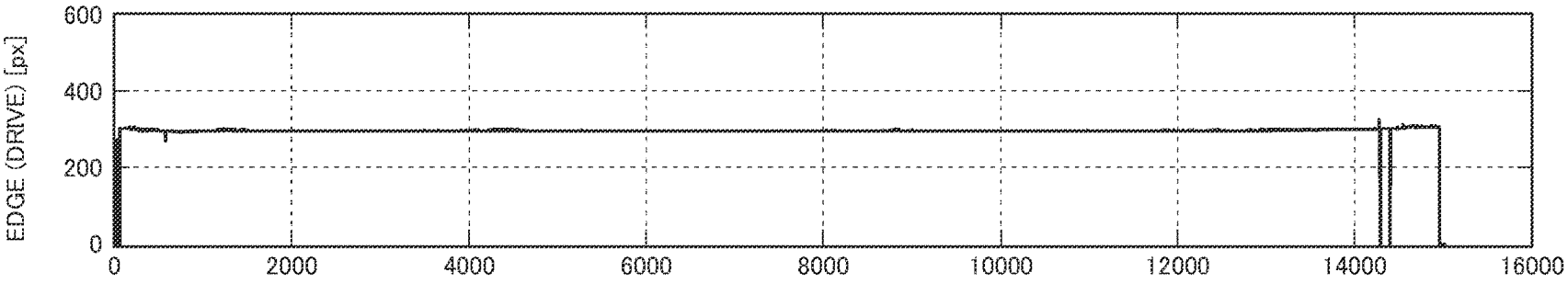
Figure 10C:
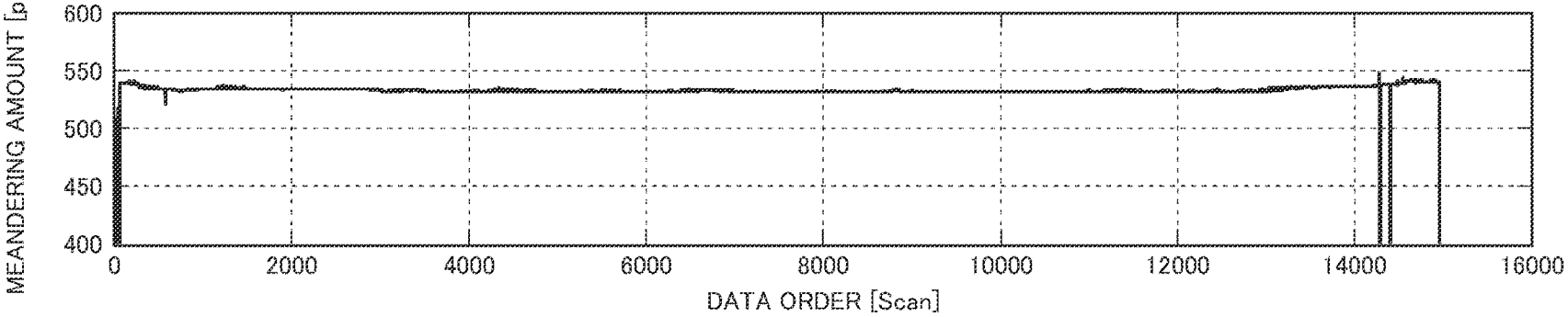

On the other hand, FIGS. 10A to 10C illustrate the results of calculating the meandering amount of the steel sheet 10 using our Example. Also in FIGS. 10A to 10C, the unit of the drive side edge sites, the work side edge sites, and the meandering amount are expressed by px (number of pixels). As illustrated in FIG. 10C, in our Example, the measured meandering amount is almost constant, and the measured meandering amount due to the vapor is reduced. The Comparative Example shows that the drive side of the steel sheet 10 in the data order of about 4000 is covered with vapor or fumes, and thus the drive side edge cannot be detected.

Therefore, in our Example, the meandering amount of the steel sheet 10 can be exactly measured in measuring the meandering amount of the steel sheet 10 during rolling when one edge (drive side edge) of the steel sheet 10 cannot be detected because the edge is covered with vapor or fumes while the other edge (work side edge) of the steel sheet 10 can be detected because the edge is not covered with vapor or fumes.

In our Example, sites where the meandering amount is 0 px in and after the data order of 14000 are sites where both the edge sites have low reliability and the meandering amount is not output to the meandering control device 7 for the control, and therefore no actual damage is caused.

Figure 11:
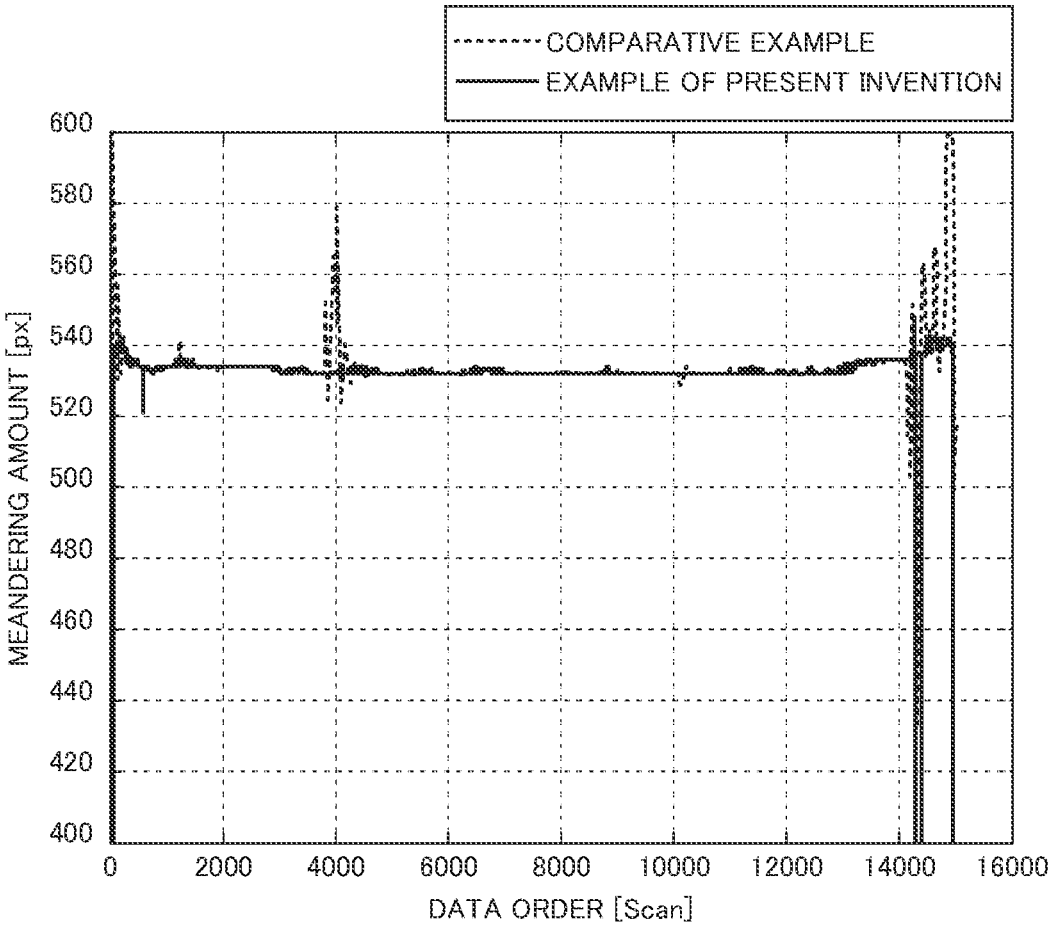
FIG. 11 is a graph illustrating a comparison of the calculated values of the meandering amount of the steel sheet calculated by an Example and a Comparative Example.

FIG. 11 also illustrates a comparison of the calculated values of the meandering amounts of the steel sheet calculated by our Example and the Comparative Example. Referring to FIG. 11, in our Example, the meandering amount of the steel sheet 10 is almost constant from the data order of 0 (tip portion of the steel sheet 10) to 14000 (tail portion of the steel sheet 10) compared to the Comparative Example, and thus it can be expected that the meandering amount can be appropriately measured, and the leveling operation of the meandering control using the same can also be optimized.

The invention claimed is:

1. A steel-sheet meandering amount measurement device measuring a meandering amount of a steel sheet during rolling by a rolling mill having a plurality of rolling stands, the device comprising:

an imaging device installed between rolling stands adjacent to each other and configured to periodically image a surface of the steel sheet traveling during rolling; and a meandering amount arithmetically operating device configured to calculate the meandering amount of the steel sheet based on a plurality of captured images captured by the imaging device;

wherein the meandering amount arithmetically operating device includes:

an uncorrected edge detection unit configured to calculate a luminance difference between pixels adjacent to each other in a width direction of each of the plurality of captured images periodically captured by the imaging device, detect a plurality of sites where an absolute value of the luminance difference is maximum on a drive side in the width direction of the steel sheet as a drive side edge site $z_{ds}$ of the steel sheet, and detect a plurality of sites where the absolute value of the luminance difference is maximum on a work side in the width direction of the steel sheet as a work side edge site $z_{ws}$ of the steel sheet;

a measurement reliability determination unit configured to determine that the drive side edge site $z_{ds}(N)$ and the work side edge site $z_{ws}(N)$ at a current time have low reliability when each of sums $\alpha_{ds}$, $\alpha_{ws}$ of change amount absolute values is equal to or larger than a predetermined threshold, and determine that the drive side edge site $z_{ds}(N)$ and the work side edge site $z_{ws}(N)$ at the current time have high reliability when each of the sums $\alpha_{ds}$, $\alpha_{ws}$ is less than the predetermined threshold, the sums $\alpha_{ds}$, $\alpha_{ws}$ being represented by Equations (1), (2) of the drive side edge sites ($z_{ds}$ (i), i=1, 2, . . . , N) and the work side edge sites ($z_{ws}$ (i), i=1, 2, . . . , N) detected by N times in a past including the current time extracted from the plurality of drive side edge sites $z_{ds}$ and work side edge sites $z_{ws}$, respectively, detected by the uncorrected edge detection unit;

a sheet width updating unit configured to calculate a number of pixels W' corresponding to a sheet width calculated from both the drive side edge site $z_{ds}(N)$ and the work side edge site $z_{ws}(N)$ at the current time and update a number of pixels W corresponding to the sheet width to the calculated W' when the measurement reliability determination unit determines that both the drive side edge site $z_{ds}(N)$ and the work side edge site $z_{ws}(N)$ at the current time have high reliability, and leave the number of pixels W corresponding to the sheet width as the number of pixels W when the measurement reliability determination unit determines that at least one of the drive side edge site $z_{ds}(N)$ and the work side edge site $z_{ws}(N)$ at the current time has low reliability; and a meandering amount calculation unit configured to calculate the meandering amount of the steel sheet using the drive side edge site $z_{ds}(N)$ and the work side edge site $z_{ws}(N)$ at the current time when the measurement reliability determination unit determines that both the drive side edge site $z_{ds}(N)$ and the work side edge site $z_{ws}(N)$ at the current time have high reliability, calculate by interpolation another side edge site using the number of pixels W from the sheet width updating unit with the drive side edge site $z_{ds}(N)$ or the work side edge site $z_{ws}(N)$ at the current time having high reliability as a reference and calculate the meandering amount of the steel sheet using the drive side edge site $z_{ds}(N)$ or the work side edge site $z_{ws}(N)$ at the current time having high reliability and the another side edge site subjected to the calculation by interpolation when the measurement reliability determination unit determines that only one of the drive side edge site $z_{ds}(N)$ and the work side edge site $z_{ws}(N)$ at the current time has high reliability, and not calculate the meandering amount of the steel sheet when the measurement reliability determination unit determines that both the drive side edge site $z_{ds}(N)$ and the work side edge site $z_{ws}(N)$ at the current time have low reliability, and wherein the sheet width updating unit, optionally, is configured to update the number of pixels W corresponding to the sheet width to the calculated W' when the calculated W' is within a preset upper and lower limit range in calculating the number of pixels W' corresponding to the sheet width calculated from both the drive side edge site $z_{ds}(N)$ and the work side edge site $z_{ws}(N)$ at the current time, and leave the number of pixels W corresponding to the sheet width as the number of pixels W when the calculated W' is out of the preset upper and lower limit range, the meandering amount arithmetically operating device, optionally, includes an uncorrected edge holding unit configured to hold the plurality of drive side edge sites $z_{ds}$ and work side edge sites $z_{ws}$ of the steel sheet detected by the uncorrected edge detection unit, wherein the measurement reliability determination unit is onfigured to acquire each of the plurality of drive side edge sites $z_{ds}$ and work side edge sites $z_{ws}$ of the steel sheet held by the uncorrected edge holding unit, and the meandering amount arithmetically operating device, optionally, includes an output unit configured to output the meandering amount of the steel sheet calculated by the meandering amount calculation unit to a meandering control device $$\alpha_{ds}=\Sigma_{i=2}^{N}|z_{dsi}-z_{dsi-1} \quad (1)$$

$$\alpha_{ws}=\Sigma z_{wsi}-z_{dwsi}-1 \quad (2).$$

2. Hot-rolling equipment for hot-rolled steel strip comprising:

the steel-sheet meandering amount measurement device according to claim 1.

3. A steel-sheet meandering amount measurement method of measuring a meandering amount of a steel sheet during rolling by a rolling mill having a plurality of rolling stands, the method comprising:

an imaging step of periodically imaging a surface of the steel sheet traveling during rolling by an imaging device installed between rolling stands adjacent to each other;

an uncorrected edge detection step of calculating a luminance difference between pixels adjacent to each other in a width direction of each of the plurality of captured images periodically captured in the imaging step, detecting a plurality of sites where an absolute value of the luminance difference is maximum on a drive side in the width direction of the steel sheet as a drive side edge site $z_{ds}$ of the steel sheet, and detecting a plurality of sites where the absolute value of the luminance difference is maximum on a work side in the width direction of the steel sheet as a work side edge site $z_{ws}$ of the steel sheet;

a measurement reliability determination step of determining that the drive side edge site $z_{ds}(N)$ and the work side edge site $z_{ws}(N)$ at a current time have low reliability when each of sums $\alpha_{ds}$, $\alpha_{ws}$ of change amount absolute values is equal to or larger than a predetermined threshold, and determining that the drive side edge site $z_{ds}(N)$ and the work side edge site $z_{ws}(N)$ at the current time have high reliability when each of the sums $\alpha_{ds}$, $\alpha_{ws}$ is less than the predetermined threshold, the sums $\alpha_{ds}$, $\alpha_{ws}$ being represented by Equations (1), (2) of the drive side edge sites ($z_{ds}$ (i), i=1, 2, . . . , N) and the work side edge sites ($z_{ws}$ (i), i=1, 2, . . . , N) detected by N times in a past including the current time extracted from the plurality of drive side edge sites $z_{ds}$ and work side edge sites $z_{ws}$, respectively, detected in the uncorrected edge detection step;

a sheet width updating step of calculating a number of pixels W' corresponding to a sheet width calculated from both the drive side edge site $z_{ds}(N)$ and the work side edge site $z_{ws}(N)$ at the current time and updating a number of pixels W corresponding to the sheet width to the calculated W' when the measurement reliability determination step determines that both the drive side edge site $z_{ds}(N)$ and the work side edge site $z_{ws}(N)$ at the current time have high reliability, and leaving the number of pixels W corresponding to the sheet width as the number of pixels W when the measurement reliability determination step determines that at least one of the drive side edge site $z_{ds}(N)$ and the work side edge site $z_{ws}(N)$ at the current time has low reliability; and a meandering amount calculation step of calculating the meandering amount of the steel sheet using the drive side edge site $z_{ds}(N)$ and the work side edge site $z_{ws}(N)$ at the current time when the measurement reliability determination step determines that both the drive side edge site $z_{ds}(N)$ and the work side edge site $z_{ws}(N)$ at the current time have high reliability, calculating by interpolation another side edge site using the number of pixels W from the sheet width updating step with the drive side edge site $z_{ds}(N)$ or the work side edge site $z_{ws}(N)$ at the current time having high reliability as a reference and calculating the meandering amount of the steel sheet using the drive side edge site $z_{ds}(N)$ or the work side edge site $z_{ws}(N)$ at the current time having high reliability and the another side edge site subjected to the calculation by interpolation when the measurement reliability determination step determines that only one of the drive side edge site $z_{ds}(N)$ and the work side edge site $z_{ws}(N)$ at the current time has high reliability, and not calculating the meandering amount of the steel sheet when the measurement reliability determination step determines that both the drive side edge site $z_{ds}(N)$ and the work side edge site $z_{ws}(N)$ at the current time have low reliability, wherein the sheet width updating step, optionally, updates the number of pixels W corresponding to the sheet width to the calculated W' when the calculated W' is within a preset upper and lower limit range in calculating the number of pixels W' corresponding to the sheet width calculated from both the drive side edge site $z_{ds}(N)$ and the work side edge site $z_{ws}(N)$ at the current time, and leaves the number of pixels W corresponding to the sheet width as the number of pixels W when the calculated W' is out of the preset upper and lower limit range, and the method, optionally, comprising an uncorrected edge holding unit step of holding the plurality of drive side edge sites $z_{ds}$ and work side edge sites Was of the steel sheet detected in the uncorrected edge detection step, wherein the measurement reliability determination step acquires each of the plurality of drive side edge sites $z_{ds}$ and work side edge sites $z_{ws}$ of the steel sheet held in the uncorrected edge holding step, and optionally, an output step of outputting the meandering amount of the steel sheet calculated in the meandering amount calculation step to a meandering control device $$\alpha_{ds}=\Sigma_{i=2}^{N}||z_{dsi}-z_{dsi-1} \quad (1)$$

$$\alpha_{ws}=\Sigma_{i=2}^{N}||z_{wsi}-z_{wsi-1} \quad (2).$$

4. A method of hot-rolling a steel strip comprising:

measuring a meandering amount of a steel sheet during rolling by a rolling mill having a plurality of rolling stands by the steel-sheet meandering amount measurement method according to claim 3.

* * * * *